US006579067B1

(12) United States Patent
Holden

(10) Patent No.: US 6,579,067 B1
(45) Date of Patent: Jun. 17, 2003

(54) VARIABLE SPEED CONTROL OF MULTIPLE COMPRESSORS

(75) Inventor: Steven J. Holden, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/029,822

(22) Filed: Dec. 31, 2001

(51) Int. Cl.[7] ..... F04B 41/06

(52) U.S. Cl. ..... 417/2; 417/3; 417/426; 417/429

(58) Field of Search ..... 417/2, 3, 426, 417/429

(56) References Cited

U.S. PATENT DOCUMENTS 3,584,977 A * 6/1971 Coleman et al. ..... 417/53
3,817,658 A * 6/1974 Murase ..... 417/2
3,850,123 A * 11/1974 LaRocca et al. ..... 72/17.1
4,765,284 A * 8/1988 Kanazawa et al. ..... 123/41.49
5,259,731 A * 11/1993 Dhindsa et al. ..... 417/3
5,343,970 A * 9/1994 Severinsky ..... 180/65.2
5,511,127 A * 4/1996 Warnaka ..... 381/71.5
5,742,500 A * 4/1998 Irvin ..... 700/9
5,797,729 A * 8/1998 Rafuse et al. ..... 417/3
6,045,331 A * 4/2000 Gehm et al. ..... 417/2
6,056,510 A * 5/2000 Miura et al. ..... 417/2
6,257,832 B1 * 7/2001 Lyszkowski et al. ..... 417/2

* cited by examiner

*Primary Examiner*—Charles G. Freay
*Assistant Examiner*—William H. Rodriguez
(74) *Attorney, Agent, or Firm*—Bryan D. Rockwell

(57) ABSTRACT

A system for variable speed control of a plurality of compressors under variable load demand. The system includes a constant power source and a plurality of compressor motors having switches to connect with the constant power source. The system further includes a variable speed drive for driving any one of the plurality of compressor motors at variable speed, wherein each of the plurality of compressor motors includes a switch to connect with the variable speed drive. Each of the plurality of compressor motors is selectively electrically connected with the variable speed drive or the constant power source via the switches, for driving the each of the plurality of motors at one of variable or constant speed in response to compressor load demands.

4 Claims, 1 Drawing Sheet

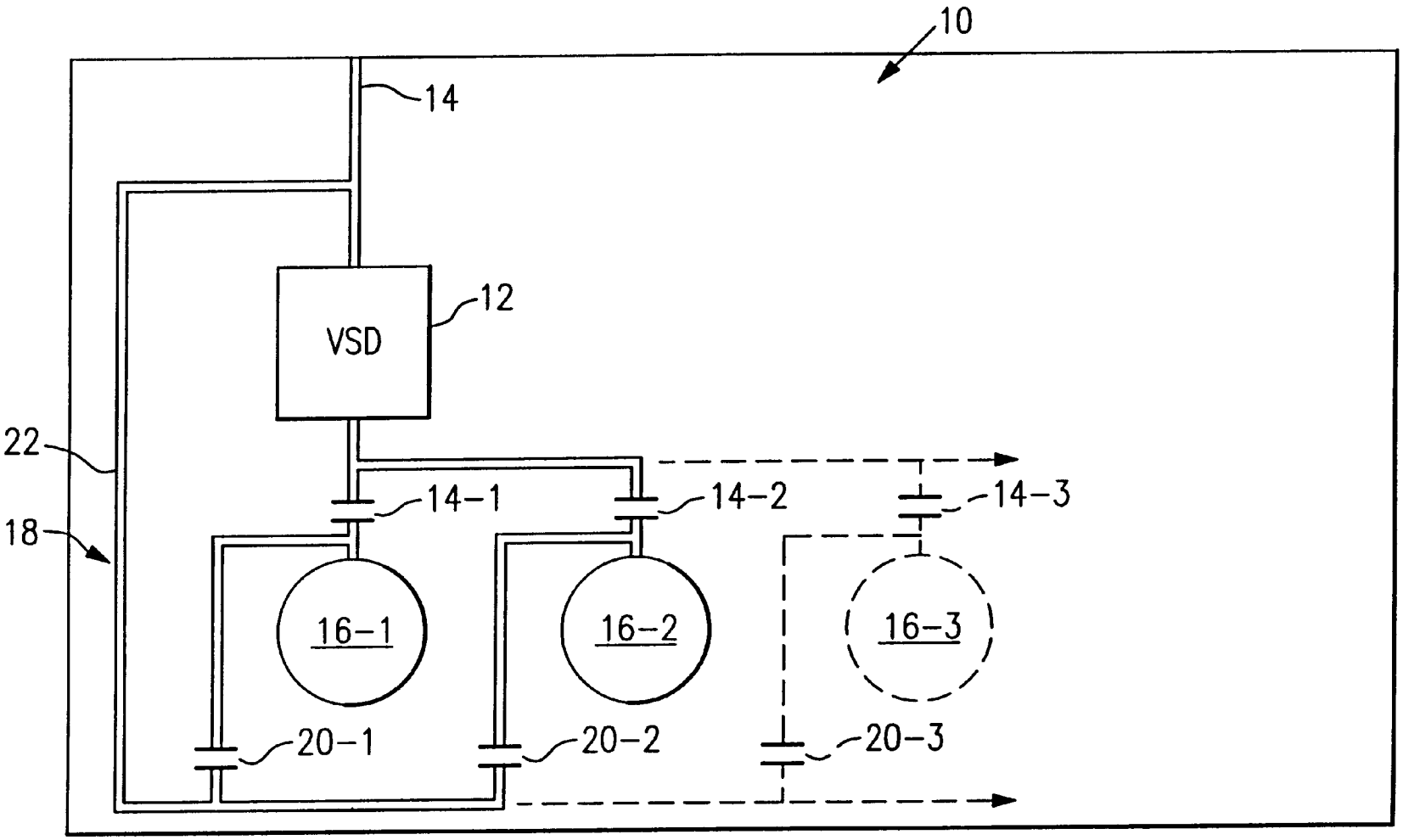
10
14
12
VSD
14-1
14-2
14-3
16-1
16-2
16-3
20-1
20-2
20-3
22
18

VARIABLE SPEED CONTROL OF MULTIPLE COMPRESSORS

TECHNICAL FIELD

This invention is directed to air conditioning and refrigeration compressor control and more particularly, to control of multiple variable speed compressors.

BACKGROUND OF THE INVENTION

Variable speed control of a compressor in a refrigeration or air conditioning application is often accomplished using a variable speed drive. This allows the removal of all unloading hardware from the compressor system. In typical applications involving more than one compressor, such as multiple circuit chillers, multiplexed compressor chillers, refrigeration, compressor racks, a variable speed control could be used with each compressor to selectively unload compressors as necessary based on system demand. Variable speed drives are expensive and therefore, multiple compressor systems requiring multiple variable speed drives also become extensively more expensive. In addition, the need for multiple variable speed drives adds to the complexity and size of the air conditioning or refrigeration system.

There exists a need therefore, for a solution which allows for the reduction in the number of variable speed drives required for multi-compressor systems so as to reduce cost and system complexity.

SUMMARY OF THE INVENTION

An object of this invention is to provide a multiple compressor system having a single variable speed drive for unloading compressors, which provides the capability to match cooling capacity with system load Another object of this invention is to provide a lower cost, less complex variable speed compressor systems with multiple compressors and motors, having a single variable speed drive.

In accordance with foregoing objects and following advantages, A system for variable speed control of a plurality of compressors under variable load demand is provided. The system includes a constant power source and a plurality of compressor motors having switches to connect with the constant power source. The system further includes a variable speed drive for driving each of the plurality of compressor motors at variable speed, wherein each of the plurality of compressor motors includes a switch to connect with the variable speed drive. Each of the plurality of compressor motors is selectively electrically connected with the variable speed drive and the constant power source via the switches, for driving the each of the plurality of motors at either variable or constant speed in response to compressor load demands.

BRIEF DESCRIPTION OF THE DRAWINGS

For a fuller understanding of the present invention, reference should now be made to the following detailed description taken in conjunction with the a ccompanying drawings wherein:

The FIGURE is a schematic diagram of the control circuit of the present invention indicating one variable speed drive driving multiple compressor motors.

DESCRIPTION OF THE PREFERRED EMBODIMENTS

Referring now to the drawings in detail, there is shown in the FIGURE, a schematic diagram of the control circuit and system of the present invention, designated generally as 10. The system includes a single Variable Speed Drive (VSD) 12, power line 14 to VSD 12, multiple switches 14-1, 14-2, 14-3, connecting VSD 12 with multiple motors 16-1, 16-2, and 16-3, respectively.

As shown, via an electric circuit 18, VSD 12 is connected with multiple compressor motors with switches 14 but circuit 18 functions to place only one motor on the VSD at a time. In this manner variable loads and a wide load range can be managed. That is, when the load exceeds the capacity of a single motor, that motor is taken off the VSD and is run full load or fixed speed in the circuit, on line power, and then another compressor is started on VSD power to provide the additional cooling capacity.

Switches 20-1, 20-2 and 20-3 are provided to place the compressor motors removed from VSD power, onto line or constant power 22. For Example, to remove motor 16-1 from VSD control, switch 14-1 is opened, and switch 20-1 is closed, placing motor 16-1 on line power 22. The VSD power can then be applied to any other motor in the system by closing the switches 14. It is important to ensure that the system is properly protected so that the switches (for example 14-1 and 20-1) to any one motor cannot be closed simultaneously. It is also important that the system is properly protected so that the switches 14 for VSD power also cannot be closed in a manner that will overload the VSD.

In operation, as the load approaches the total capacity of the unit, the system will have all of the compressors running on line power except for the last compressor started, for example 16-3. This last motor will continue to run on VSD power until the load on the system begins to diminish. As the load diminishes, motor 16-3 reduces in speed until it is no longer needed to satisfy the load. At this time motor 16-3 is turned off by opening switch 14-3, and another motor, for example 16-2, is changed from line power to VSD power by opening switch 20-2 and closing switch 14-2. This method of capacity reduction continues until no motor are operating on line power and only one motor is operating on VSD power. Any number of compressor motors can be effectively controlled in this manner through the use of a single VSD.

A primary advantage of this invention is that a multiple compressor system is provided having a single variable speed drive for loading and unloading compressors based on demand, which can provide a better match between system capacity and load.

Another advantage of this invention is that a lower cost, less complex variable speed compressor system is provided, having multiple compressors and motors controlled by a single variable speed drive, such that the VSD need only be sized to provide sufficient power for the largest single motor that may be run from it.

Although the present invention has been specifically illustrated and described in terms of a specific embodiment, it is applicable to any type of compressor (screw, reciprocating, rotary, scroll, etc) capable of running effectively under variable speed control. The invention is also generic to the type of variable speed drive hardware used and thus is applicable to any type of variable speed drive. It is therefore intended that the present invention is to be limited only by the scope of the appended claims.

What is claimed is:

1. A system for variable speed control of a plurality of compressors under variable load demand, comprising:

a constant power source;

a plurality of compressor motors having means to connect with said constant power source;

means for driving each of said plurality of compressor motors at variable speed, wherein each of said plurality of compressor motors includes means to connect with said means for driving; and wherein each of said plurality of compressor motors is selectively electrically connected with said means for driving and said constant power source via said means to connect, for driving said each of said plurality of motors at one of variable and constant speed in response to load demand.

2. The system according to claim 1, wherein said means for driving is a single variable speed drive.

3. The system according to claim 1, wherein said means for driving is electrically connected with only one of said plurality of motors at a time.

4. The system according to claim 3, wherein said each of said plurality of motors which is not electrically connected with said means for driving is electrically connected with said constant power source or is disconnected from all power sources.

* * * * *